US006793043B2

(12) United States Patent
Nguyen

(10) Patent No.: US 6,793,043 B2
(45) **Date of Patent: *Sep. 21, 2004**

(54) METHODS AND APPARATUS FOR IMPROVED REGISTER CHECKOUT

(75) Inventor: Dung Nguyen, Rogers, AR (US)

(73) Assignee: Wal-Mart Stores, Inc., Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/282,381

(22) Filed: Oct. 29, 2002

(65) Prior Publication Data

US 2003/0052166 A1 Mar. 20, 2003

Related U.S. Application Data

(63) Continuation of application No. 09/745,758, filed on Dec. 21, 2000, now Pat. No. 6,491,218.

(51) Int. Cl.[7] ..... A63F 9/02

(52) U.S. Cl. ..... 186/59; 186/61; 186/66; 186/67; 211/85.15; 211/129.1; 235/375

(58) Field of Search ..... 186/59, 61, 66, 186/64; 211/85.18, 129.1, 131.1, 131.2, 133.1, 133.4, 163

(56) References Cited

U.S. PATENT DOCUMENTS

| | | | |
|---|---|---|---|
| 1,124,459 | A | 1/1915 | King et al. |
| 1,224,475 | A | 5/1917 | Logan |
| 1,580,163 | A | 4/1928 | Peterson et al. |
| 2,324,596 | A | 7/1943 | Quain |
| 2,871,984 | A | 2/1959 | Colman |
| 2,976,089 | A | 4/1961 | Shoffner |
| 3,028,713 | A | 4/1962 | Kennedy et al. |
| 3,075,616 | A | 1/1963 | Shoffner |
| 3,112,777 | A | 12/1963 | Lohse |

(List continued on next page.)

FOREIGN PATENT DOCUMENTS

| | | | | |
|---|---|---|---|---|
| CA | EP 0 498 311 A1 * | 1/1992 | | |
| CA | EP0498311 A1 * | 12/1992 | ..... | G07G/1/00 |
| EP | 0 498 311 B1 | 12/1995 | | |
| FR | 002674115 A1 | 9/1992 | | |
| WO | WO 01/15753 A1 * | 2/2002 | | |
| WO | WO/02/15753 A1 | 2/2002 | | |

*Primary Examiner*—Karl D. Frech
*Assistant Examiner*—Daniel Walsh
(74) *Attorney, Agent, or Firm*—Priest & Goldstein, PLLC

(57) ABSTRACT

Systems and techniques for more efficient checkout are described. A triangular carousel having a relatively small footprint is employed proximate a bar code scanner and point of sale (POS) terminal so that a checker can efficiently load scanned items into bags, and a customer on the other side of the checkout counter and proximate the bar code scanner can also efficiently load filled bags into his or her shopping cart.

26 Claims, 7 Drawing Sheets

U.S. PATENT DOCUMENTS 3,126,981 A 3/1964 Crawford
3,693,807 A * 9/1972 Larson ..... 211/163
3,695,455 A * 10/1972 Larson ..... 211/78
3,709,449 A * 1/1973 Martin et al. ..... 248/101
3,721,063 A 3/1973 Welmer
3,792,757 A 2/1974 Musser
3,863,370 A * 2/1975 Smith ..... 40/367
4,037,778 A * 7/1977 Boyle ..... 141/390
4,062,170 A 12/1977 Orem
4,199,122 A 4/1980 Christie
4,265,335 A 5/1981 Joseloff
4,316,353 A 2/1982 Suominen
4,330,048 A 5/1982 Joseloff
4,389,834 A 6/1983 Wysocki
4,398,689 A 8/1983 Prader
4,487,388 A 12/1984 Provan
4,512,540 A 4/1985 Stroh
4,559,762 A 12/1985 Soltus et al.
5,078,283 A * 1/1992 Wilson ..... 211/187
5,083,638 A 1/1992 Schneider
5,115,888 A 5/1992 Schneider
5,131,499 A * 7/1992 Hoar ..... 186/66
5,167,301 A 12/1992 Cappi et al.
5,174,399 A * 12/1992 Brauneis ..... 177/25.15
5,210,994 A 5/1993 Lynn
5,211,263 A 5/1993 Davidson et al.
5,366,189 A 11/1994 Thompson
5,378,056 A * 1/1995 Wilson et al. ..... 312/249.8
5,394,993 A * 3/1995 Gravell et al. ..... 211/12
5,462,178 A 10/1995 Wallach et al.
5,465,845 A 11/1995 Norby et al.
5,467,572 A 11/1995 Wile et al.
5,551,531 A * 9/1996 Dumont ..... 186/61
5,732,833 A * 3/1998 Alvarado et al. ..... 211/59.1
5,735,494 A * 4/1998 Kurk ..... 248/97
5,735,499 A * 4/1998 Phillips et al. ..... 248/230.1
5,885,002 A 3/1999 Reiss
5,978,722 A 11/1999 Takasuka et al.
5,992,570 A 11/1999 Walter et al.
6,086,023 A 7/2000 Kerr et al.
6,491,218 B2 * 12/2002 Nguyen ..... 235/383
6,550,583 B1 * 4/2003 Brenhouse ..... 186/66
2003/0222092 A1 * 12/2003 Sherrod ..... 221/92

* cited by examiner

METHODS AND APPARATUS FOR IMPROVED REGISTER CHECKOUT

The present application claims the benefit of and is a continuation of allowed U.S. application Ser. No. 09/745,758 entitled "Methods and Apparatus for Improved Register Checkout" filed Dec. 21, 2000, now U.S. Pat. No. 6,491,218, and incorporated by reference herein in its entirety.

FIELD OF THE INVENTION

The present invention relates generally to improved methods and apparatus for register checkout. More particularly, the present invention provides a triangular turntable or carousel to improve the efficiency of bagging products as they are checked and the delivering of bagged products to customers for loading into their cart or for carrying from a store.

BACKGROUND OF THE INVENTION

Register checkout stations are a familiar aspect of the shopping experience. Particularly in grocery and large retail stores, it is common to find an arrangement 10 in which a customer unloads a shopping cart or basket of items onto a conveyor belt 12 which conveys the items to a cashier or checker who then scans them utilizing a bar code scanner 14. The checker typically stands beside a point of sale (POS) terminal 15. The scanned items are then placed by the checker onto an inclined ramp or a second conveyor 16 which conveys them to a collection area 18 from which the checker, a dedicated bagger, or in some cases the customer then bags them.

FIG. 1A and the remaining figures are not drawn to scale; however, break lines 17 and 17' and 19 are included in FIG. 1A to indicate that the second conveyor 16 and collection area 18 will typically be longer than illustrated so that it will be understood that arrangement 10 of FIG. 1A has a relatively large footprint and the distance "d" from the checker's normal scanning position proximate to said scanner 14 and terminal 15 to the back of collection area 18 where scanned items collect is a relatively long distance requiring the checker to walk several steps to do bagging if not assisted by another individual dedicated to bagging who is able to bag as quickly as the checker can scan and check out the customer.

A much more compact arrangement 20 is shown in FIG. 1B. In the arrangement 20, the customer again places items onto a conveyor 22 which conveys them to the checker who scans them utilizing a scanner 24 and then places the items directly into one or more bags 25 and 26 hanging from a supporting rack or racks 27 located after scanner 24 and before an optional catch area 28. For the approach of arrangement 20, the checker can bag scanned items directly with little foot movement from a position adjacent scanner 24 and POS terminal 25.

However, both of the above described approaches require the checker to engage in a large number of potentially unnecessary movements such as walking from the scanning position to the bagging area for an arrangement such as the arrangement 10 of FIG. 1A, or lifting full bags, such as bags 25 and 26 from below the level of the counter up over and across the checkout counter and then placing them up on the counter for the customer, or even lowering these bags into the customer's cart in an arrangement, such as that of FIG. 1B.

Two alternative arrangements 210 and 220 shown in FIGS. 2A and 2B, respectively, proposed an octagonal carrousel 212 for eight bags or a rectangular carousel 222 for four bags to replace the approaches of FIG. 1A or 1B. The eight bag octagonal unit results in a relatively large footprint, as the octagonal carousel 212 turns within a circle having diameter D. The checker also needs to frequently turn the unit to continue to feed bags into a position for loading. Also, a checker needs to turn the unit through several positions to rotate bags to a position where the customer can take his or her bag or bags. By way of example, the bag at position A in FIG. 2A has to be rotated all the way to position B before it can be readily accessed by the customer. Conversely, the rectangular four bag unit requires a 180 degree turn to get a new set of empty bags into position for loading. With this rotation, the bagged items are now placed somewhat inconveniently for unloading as the customer may wish to stay adjacent the bar code scanner to receive change, sign a credit receipt or the like. The 180 degree rotation is also unnecessarily time consuming and therefore is inefficient. Because of the large number of rotations occurring in a typical checker's shift even a small difference may be significant.

A further retail store checkout device is described in U.S. Pat. No. 5,131,499 which is incorporated by reference in its entirety. The described device includes a rotating carousel for use in conjunction with plastic bags. The preferred form of the device of the above patent has six triangular compartments for holding bags.

SUMMARY OF THE INVENTION

Among its other aspects, the present invention advantageously provides a small footprint device which with a single clockwise or counterclockwise rotation of approximately 120° carries filled bags to a position from which customers can readily load them into their carts while leaving a reserve of empty bags for the checker to continue bagging further items into. To this end, according to one aspect of the present invention, a triangular carousel is provided for three pairs of two side by side bags. These side by side bags allow the ready separation of products such as frozen foods, chemicals such as cleaning products and the like from other products which are typically separated from those products by checkers of grocery or other products. Large or bulky items such as a gallon of milk, large packages of pet food, a twelve pack of soda or the like can be placed on a top triangular surface of the carousel in a single motion as the checker swipes the item across the scanner. When a checker rotates the last bags of a customer's items for loading, the checker can then immediately begin bagging items for the next customer in line while the previous customer loads his or her cart. Thus, the present invention may increase productivity, decrease customer waiting, and increase customer satisfaction through greater control of the bagging process.

These and other advantages of the present invention will be apparent from the drawings and the Detailed Description which follows below.

DETAILED DESCRIPTION

The present invention now will be described more fully with reference to the accompanying drawings, in which several presently preferred embodiments of the invention are shown. This invention may, however, be embodied in various forms and should not be construed as limited to the embodiments set forth herein. Rather, these embodiments are provided so that this disclosure will be thorough and complete, and will fully convey the scope of the invention to those skilled in the art.

Figure 2A:
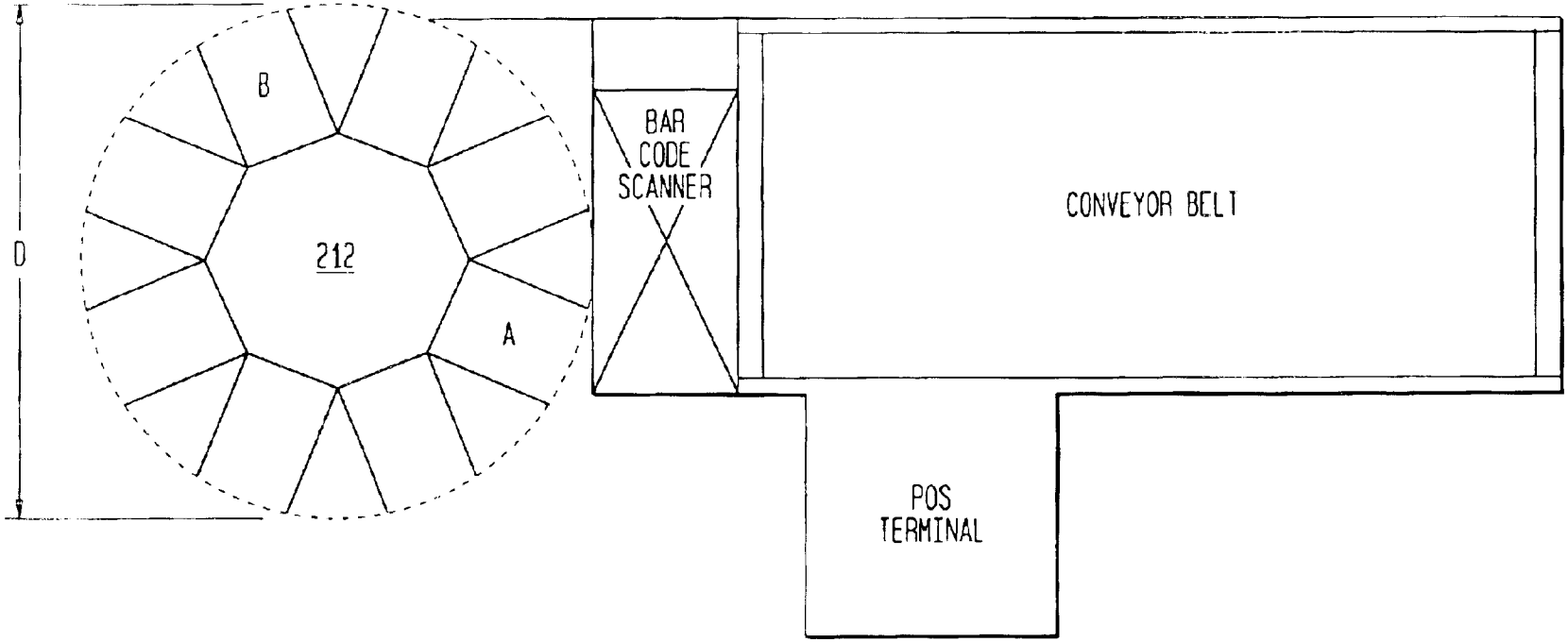
FIG. 2A (PRIOR ART)
FIG. 2A is a schematic drawing illustrating a third prior art checkout station having an eight bag octagonal bagging carousel.
Figure 3A:
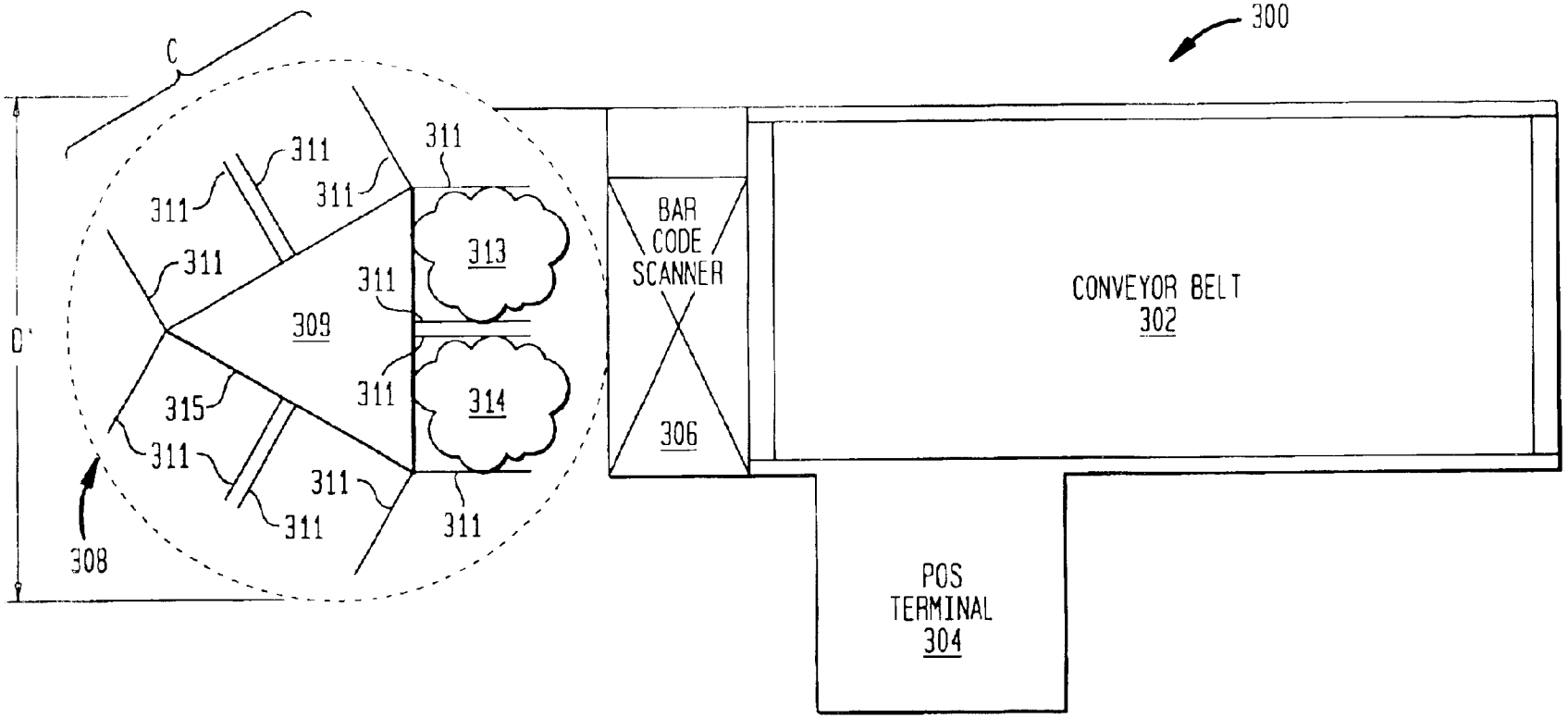
FIG. 3A is a schematic drawing illustrating a checkout station having a six bag triangular bagging carousel in accordance with the present invention.
Figure 3B:
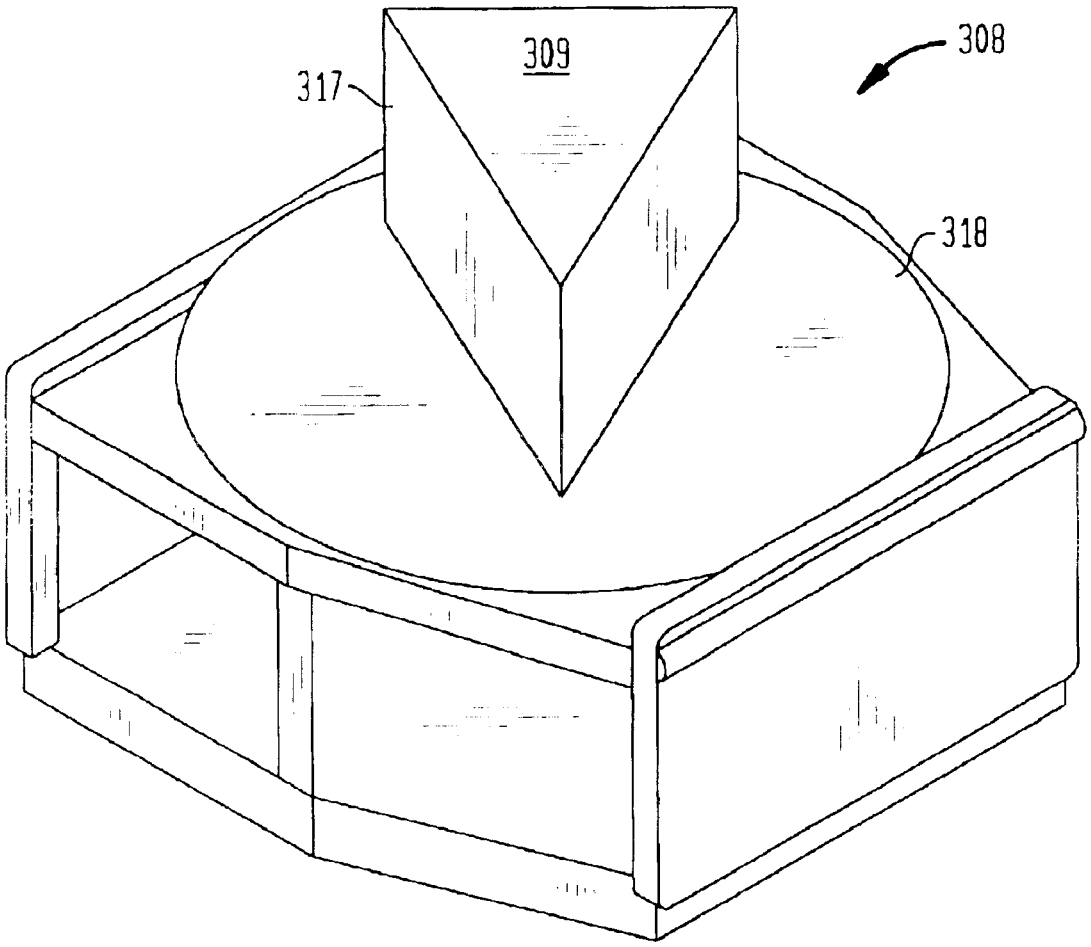
FIG. 3B is a perspective drawing of the six bag triangular bagging carousel of FIG. 3A.

FIG. 3A illustrates an improved checkout apparatus 300 in accordance with the present invention. The apparatus 300 preferably includes a conveyor belt 302, a POS terminal 304, a bar code scanner 306, and a six bag triangular bagging carousel 308. It will be recognized that checkout apparatus 300 may further include any of a variety of additional components typically found in a grocery or retail store environment. By way of example, and not by way of limitation, such components may include a customer price display, a credit/debit card swipe reader, a scale built into the scanner unit, and the like. The bagging carousel 308 has a top surface 309 which is preferably arranged at about the same height above the floor as conveyor 302 and bar code scanner 306. The carousel 308 also includes a plurality of metal racks or arms 311 which are arranged as shown in FIG. 3A to hold a pair of shopping bags on each face of triangular bagging carousel 308. Distance D' in FIG. 3A is substantially less than distance D of FIG. 2A and consequently carousel 308 has a smaller footprint. FIG. 3B shows a perspective view of the triangular bagging carousel 308 of FIG. 3A. In FIG. 3B, bag supporting racks 311 are not shown for ease of illustration. As seen in FIG. 3B, triangular block 317 is mounted on a rotatable circular base 318. This base 318 is seen to extend outwardly from the triangular piece and provides support for the shopping bags held by the metal racks or arms.

Figure 4:
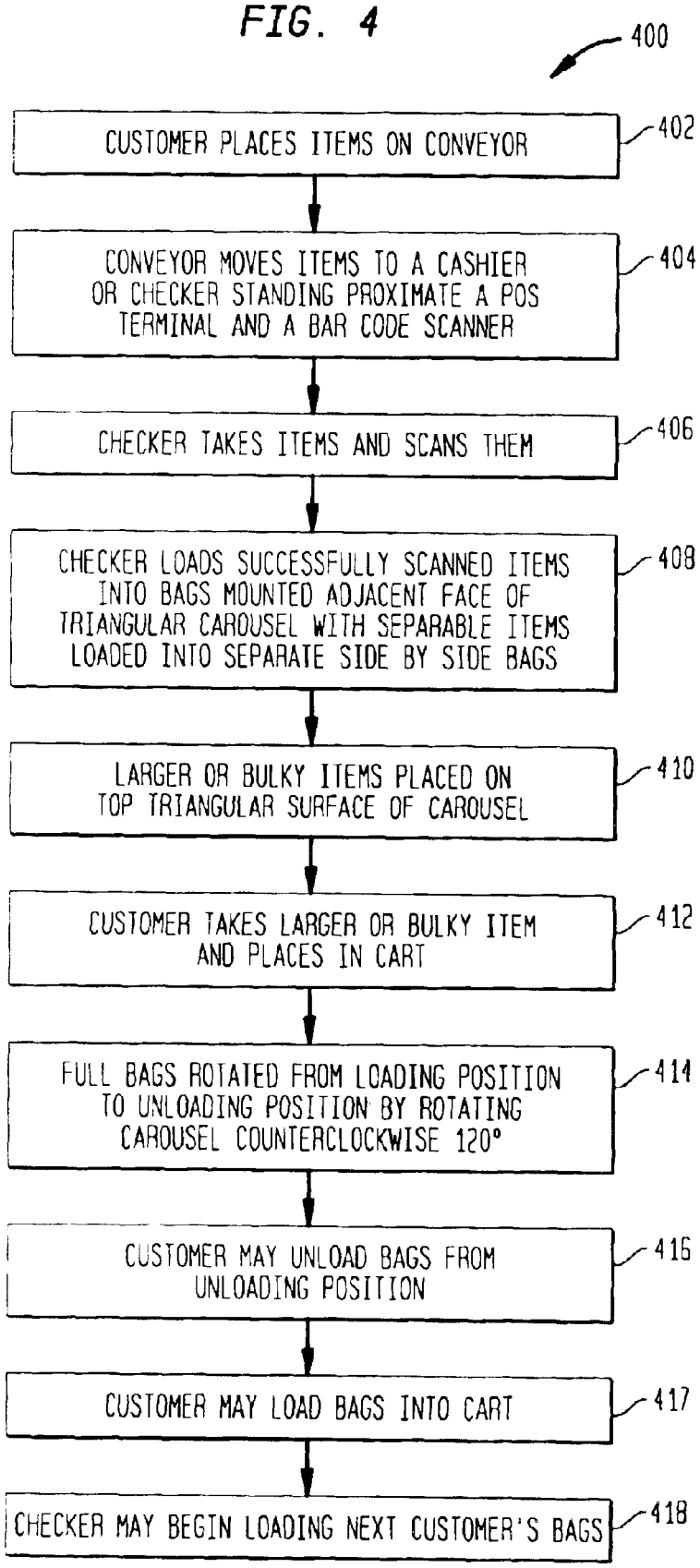
FIG. 4 is a flowchart of a method in accordance with the present invention.

In a typical operation of the apparatus 300, according to a method of operation 400 illustrated in FIG. 4, a customer places items, such as groceries, retail store items or the like on the conveyor belt 302 in step 402. The conveyor 302 moves the items to a cashier or checker standing proximate the POS terminal 304 and the bar code scanner 306, in step 404. The checker takes the items from the conveyor 302 and scans them one by one using the bar code scanner 306, in step 406. After a successful scan of an item which may be determined by a beep or other sound indicator from an enunciator, a light indicator such as a green LED lighting, or both, the checker loads the item into one of bags 313 and 314 which are in a loading position proximate the bar code scanner 306, in step 406. In step 408, the checker loads successfully scanned items into bags proximate the cashier and mounted adjacent a face of the triangular carousel with separable items loaded into separate side by side bags. The pair of bags 313 and 314 located adjacent one of the triangular faces of carousel 308 advantageously allows the checker to separate items into different bags without unnecessary rotation or movement of the carousel 308. Examples of such items are frozen foods, and other food items in a grocery store; detergents, chemicals such as bleach or bathroom products which are typically separated from food or other items by a careful checker; or breakable items such as eggs, light bulbs and the like which are again typically separated from heavier objects which could break them if packed or carried carelessly. While the above list is exemplary only, it will be recognized that the side by side bag arrangement of carousel 308 is highly advantageous.

Larger or bulky items, such as large containers of pet food, a gallon of milk, an eight roll package of toilet paper, a twelve pack of soda or the like can be scanned and placed on upper or top surface 309 of carousel 308, in step 410. From this surface, the customer can easily reach the item and place it in his or her basket, in step 412. Because the top surface 309 is at about the same height above the floor as the top surface of scanner 306 and located proximate thereto, the checker can relatively easily swipe a large, heavy item over the top of the bar code scanner and place it on top surface 309 in one fluid motion. In a presently preferred embodiment, top surface 309 is about 1–2" above the top surface of scanner 306.

After bags 313 and 314 are full or once all the customer's items have been scanned and bagged, in step 414, the carousel 308 is rotated once about 120® so that bags 313 and 314 are now in unloading position, position C. Bags not shown in FIG. 3B for ease of illustration as hung from racks or arms 311 on trailing face 315 of carousel 308 are now in the loading position. Having paid for the items, the customer with only two bags can take the bags in hand and depart the store in step 416. Alternatively, in step 417, the customer with several bags can readily transfer the bags from the loading position to his or her cart thus reducing the workload for the checker and speeding the checkout process. Once the customer has paid, the checker can begin loading the next customer's items while the previous customer is finishing the step of loading his or her cart in preparation for leaving the store, in step 418. As part of this process, the checker should be sure that the previous customer has taken all of his or her bags and assist in loading if the customer needs or wants such assistance. Where the customer requires assistance, the checker can fill all the bags needed to bag the customer's entire purchase, and then come around to the cart using the rotation of the carousel to rotate bags into position for unloading. This avoids the stopping of scanning and bagging to load a bag or bags, and then starting back up again.

Figure 1A:
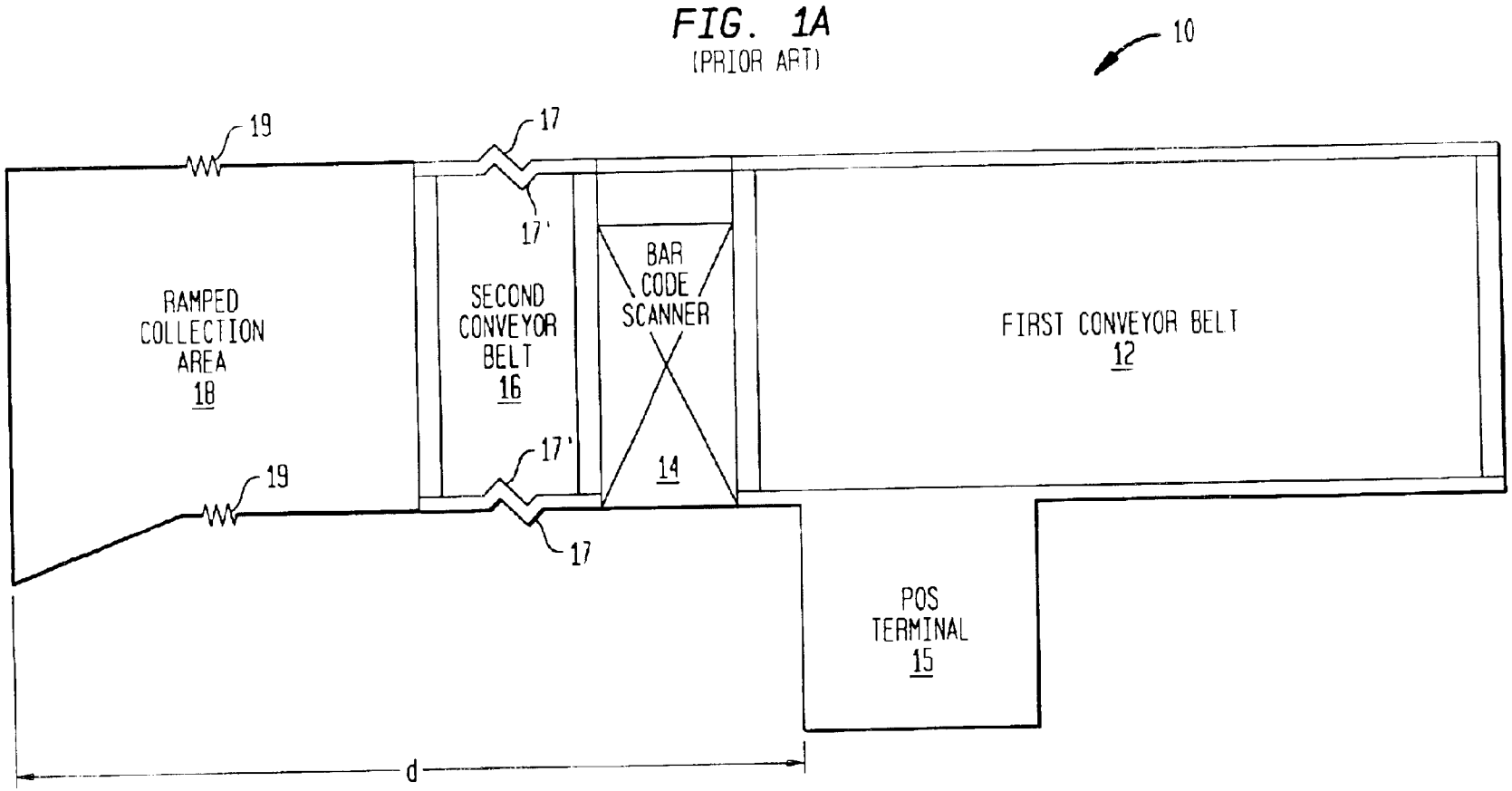
FIG. 1A (PRIOR ART)
FIG. 1A is a schematic drawing illustrating a first prior art checkout station.

Thus, it is seen that the present invention has a number of advantages over the prior art. Among these advantages are the following which are listed as exemplary and not as exclusive. First, when compared with the arrangement 10 of FIG. 1A, the present arrangement has a much smaller footprint so that expensive store square footage is saved. Also, the checker does not have to walk back and forth from the checking position to the bagging position. While having a substantially larger footprint than the arrangement 20 of FIG. 1B if an optional catch area 28 is not included in that arrangement, the present invention advantageously reduces the need for the checker to lift heavy filled bags 25 and 26 up over the counter and then lower them into the customer's cart or placing them on the counter for the customer to take. A study of a presently preferred embodiment of the present invention showed that about 80% of customers voluntarily participate in loading full bags into their carts. Such customer participation may reduce customer impatience related to waiting to complete check out, allows the customer to choose how to place items and helps assure the customer that nothing has been left behind. Also, a surface, top surface 309 is provided for bulky and heavy items as discussed above.

Figure 1B:
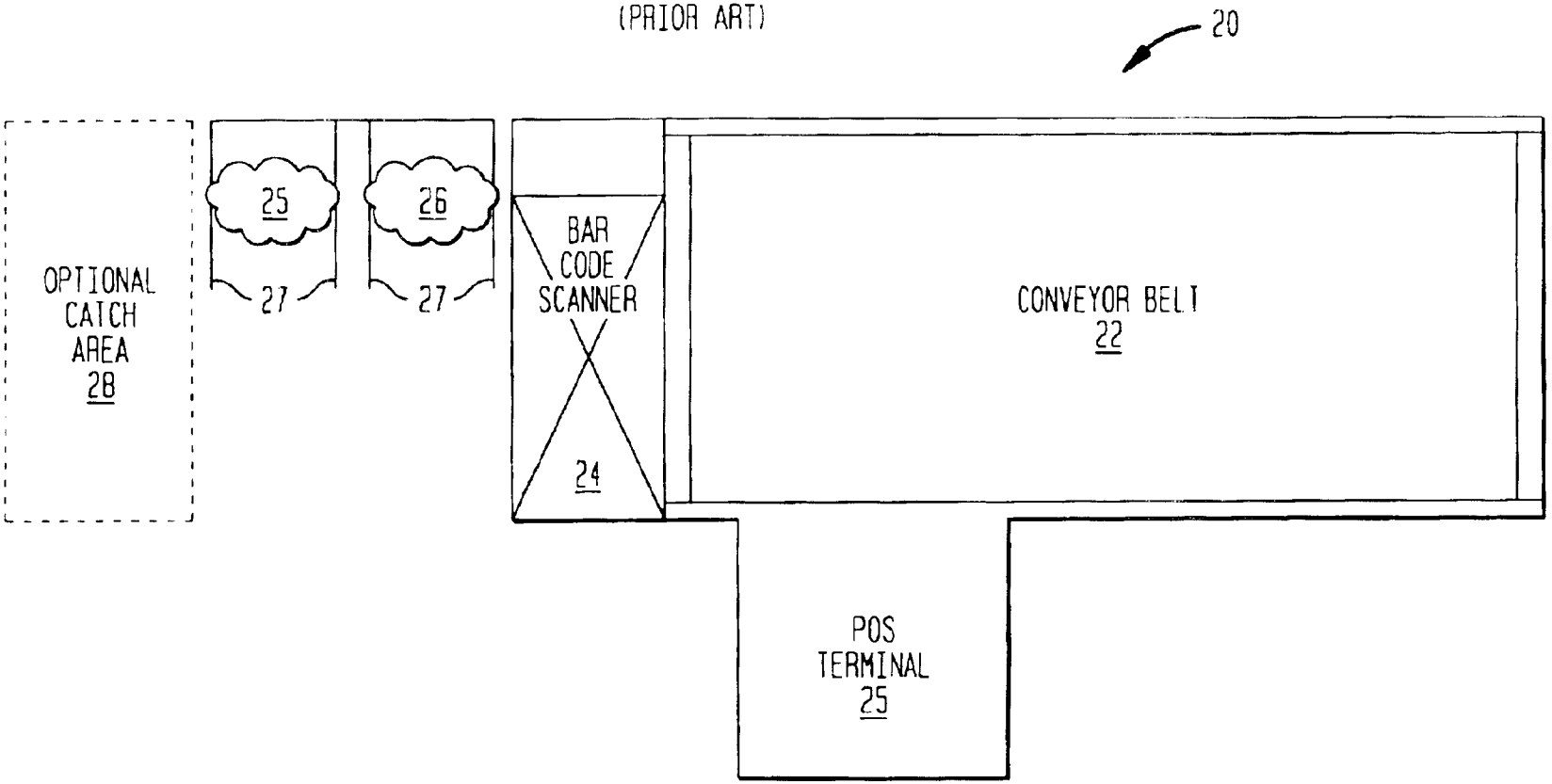
FIG. 1B (PRIOR ART)
FIG. 1B is a schematic drawing illustrating a second prior art checkout station.

Should the optional catch area 28 be included in the arrangement 20 of FIG. 1B, then that arrangement has a convenient area for bulky and heavy items, but the checker still has the job of lifting bags onto the catch area 28, or of handing them to the customer, or of placing them into the customer cart.

Figure 2B:
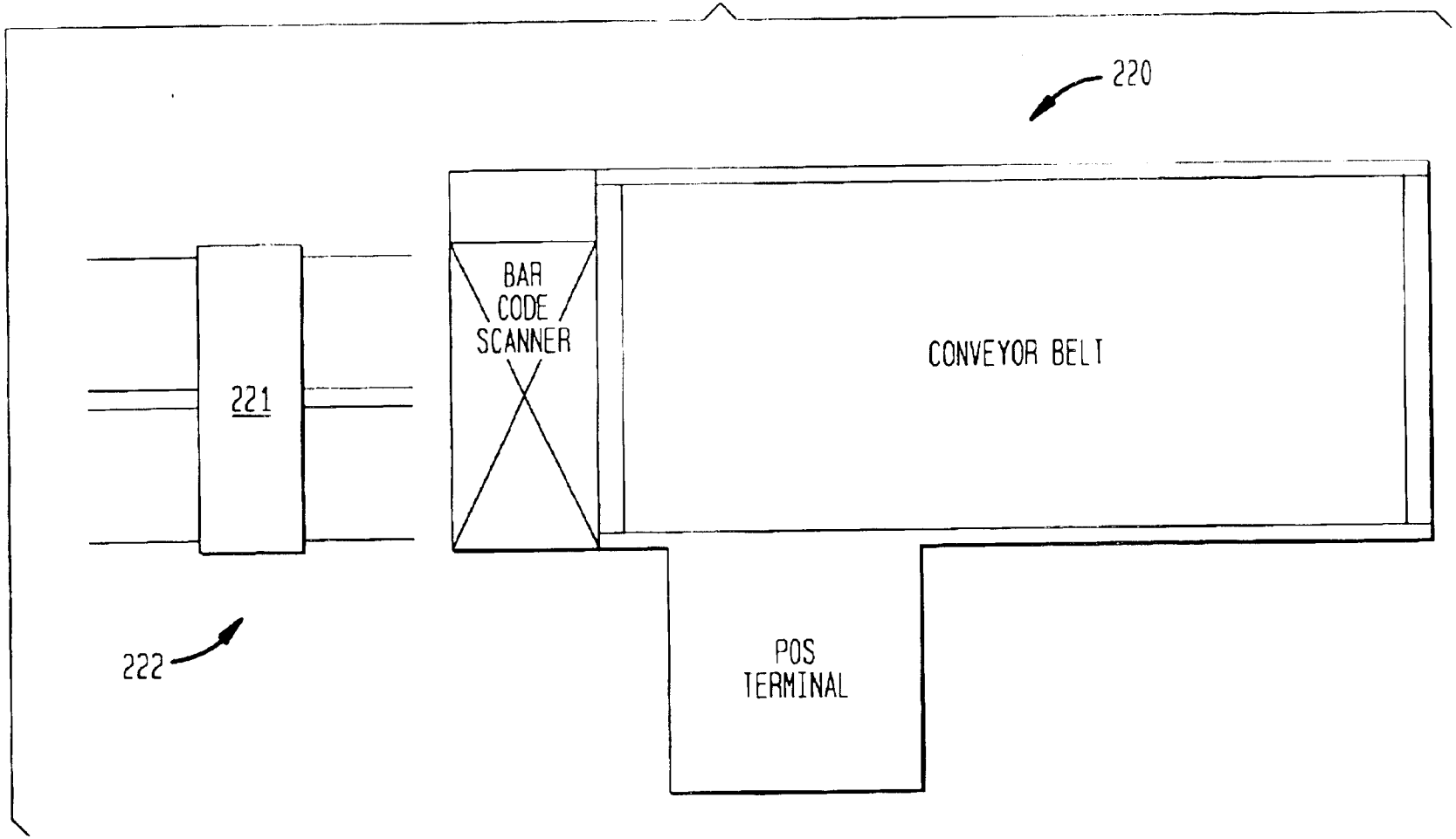
FIG. 2B (PRIOR ART)
FIG. 2B is a schematic drawing illustrating a fourth prior art checkout station having a four bag rectangular bagging carousel.

With respect to the eight bag octagonal carousel 212 of the arrangement 210 of FIG. 2A, the present triangular carousel 308 has a substantially smaller footprint and requires less frequent rotation of the carousel while providing ready access to side by side pairs of bags allowing ready packing and unloading. Finally, with respect to the four bag carousel arrangement of FIG. 2B, top surface 309 is much better suited to holding large bulky or heavy items than the narrow rectangular top surface 221 seen in FIG. 2B. The substantially 180® rotation of the rectangular carousel 222 of FIG. 2B results in an unnecessarily large angle of rotation and also places the loaded bags in an inconvenient position for unloading, since the customer may be waiting proximate the bar code scanner to sign a credit card slip, receive his or receipt, receive change, or the like. The present arrangement places the unloading position in a location highly convenient to the customer thereby encouraging the customer to perform the unloading step.

While the present invention has been disclosed in the context of a presently preferred embodiment, it will be recognized that a wide variety of implementations may be employed by persons of ordinary skill in the art consistent with the above discussion and the claims which follow below. By way of example, while it is presently preferred to employ an embodiment in which pairs of bags are hung adjacent from each face of the triangular carousel, it may be desired to employ a smaller carousel having only a single bag on each face. It is anticipated that such a smaller carousel design will be particularly useful in a speedy checkout environment in which a lane or lanes are dedicated to checking out customers with a limited number of items such as ten or less, twenty or less, or the like.

I claim:

1. A triangular bagging carousel comprising:

a rotatable triangular piece having three sides and a triangular top surface;

a plurality of bag support racks extending from the three sides of the rotatable triangular piece; and a base for supporting the rotatable triangular piece.

2. The apparatus of claim 1 wherein the rotatable triangular piece is rotatable in a counterclockwise direction.

3. The apparatus of claim 1 wherein the rotatable triangular piece is rotatable in a clockwise direction.

4. The apparatus of claim 1 wherein the triangular top surface has a sufficient area to support large or bulky store items.

5. The apparatus of claim 1 wherein said carousel is adapted for use in a speedy checkout environment and each of the three sides of the rotatable triangular piece has only two bag support racks to support only a single bag.

6. The apparatus of claim 1 wherein said carousel is adapted for bagging items for which it may be desired to separate particular ones of said items into separate bags, and the three sides of the rotatable triangular piece have a length long enough so that two bags can be supported side by side thereon and each of the three sides has four bag support racks to support two bags side by side.

7. The apparatus of claim 6 wherein said carousel is rotatable from a first bagging position in which two bags are proximate a cashier and to a second unloading position proximate a customer by rotating the triangular piece about 120°.

8. A register checkout apparatus comprising:

a bar code scanner utilized to scan items to be purchased; and a triangular bagging carousel located proximate to the bar code scanner, said triangular bagging carousel comprising a rotatable triangular niece having three sides and a triangular top surface; a plurality of bar support racks extending from the three sides of the rotatable triangular piece; and a base for supporting the rotatable triangular piece.

9. The apparatus of claim 8 wherein the triangular bagging carousel is adapted for a speedy checkout environment and each of the three sides of the rotatable triangular piece has only two bag support racks to support only a single bag.

10. The apparatus of claim 8 wherein said carousel is adapted for bagging items for which it may be desired to separate particular ones of said items into separate bags, and the three sides of the rotatable triangular piece have a length long enough so that two bags can be supported side by side thereon, and each of the three sides has four bag support racks to support two bags side by side.

11. The apparatus of claim 8 wherein the register checkout apparatus further comprises:

a conveyor belt operative to convey customer selected items to a cashier proximate the bar code scanner for scanning; and a point of sale terminal.

12. The apparatus of claim 11 wherein the triangular bagging carousel has a top surface of sufficient size to support large or bulky items and the top surface is approximately the same distance above the floor as a top surface of the bar code scanner so that the cashier can scan a large or bulky item and deposit the scanned item on the triangular top surface utilizing a relatively fluid motion.

13. An improved method for retail checkout comprising the steps of:

scanning an item to be purchased with a bar code scanner;

directly bagging the item if successfully scanned into at least one bag supported by a rotatable triangular carousel in a loading position proximate the bar code scanner;

continuing to scan and bag items until the at least one bag is full; and rotating the at leant one full bag from the loading position to an unloading position proximate a cart by rotating the rotatable triangular carousel about 120°.

14. The method of claim 13 further comprising the step of:

continuing to scan and bag items for a subsequent customer as a previous customer unloads.

15. The method of claim 13 wherein the rotatable triangular carousel supports two bags from each of its three sides and the method further comprises the step of:

separating successfully scanned items into either one of the two bags in the loading position as appropriate.

16. The method of claim 13 further comprising the steps of:

placing items to be purchased on a conveyor; and conveying said items to be purchased to a position proximate the bar code scanner.

17. The method of claim 13 further comprising the step of:

scanning a large or bulky item and placing it on a triangular top surface of the rotatable triangular carousel.

18. A triangular bagging carousel comprising:

a triangular body having three side portions and a top triangular portion;

bag support racks extending from the three side portions of the triangular body; and a rotatable base having a fixed vertical axis supporting the triangular body;

means for constraining said rotatable base to rotate on said vertical axis.

19. The triangular bagging carousel of claim 18 wherein the top triangular portion has sufficient surface area to allow the placement of a large store item.

20. The triangular bagging carousel of claim 18 wherein the bag support racks support two groups of bags on each side portion of the triangular body.

21. The triangular bagging carousel of claim 18 wherein the three side portions comprise solid surfaces.

22. The triangular bagging carousel of claim 18 wherein the top triangular portion comprises a solid surface.

23. The triangular bagging carousel of claim 18 wherein the rotatable base is rotatable from a first position in which one side portion is proximate a cashier's scanning location to a second position in which said one side portion is proximate a customer's location.

24. The triangular bagging carousel of claim 23 wherein the rotatable base is rotated about 120° when rotated from the first position to the second position.

25. A method for retail checkout comprising the steps of:

scanning an item to be purchased with a bar code scanner;

placing successfully scanned items into at least one bag supported by a triangular carousel in a loading position proximate the bar code scanner; and rotating the at least one bag from the loading position to an unloading position by rotating a portion of the triangular carousel about 120°.

26. A register checkout apparatus comprising:

a bar code scanner utilized to scan items to be purchased; and a triangular bagging carousel located proximate to the bar code scanner, said triangular bagging carousel comprising: a triangular body having three side portions and a top triangular portion; bag support racks extending from the three side portions of the triangular body, a rotatable base having a fixed vertical axis supporting the triangular body; and means for constraining said rotatable base to rotate on said vertical axis.

* * * * *